United States Patent [19]

Sugawara et al.

[11] Patent Number: 4,730,418

[45] Date of Patent: Mar. 15, 1988

[54] ABRASING APPARATUS USING MAGNETIC ABRASIVE POWDER

[75] Inventors: Shuichi Sugawara, Abiko; Hisatsugu Kaji; Masaaki Shimada, both of Iwaki, all of Japan

[73] Assignees: Kureha Chemical Industry Company Limited; Tohbu MX Limited, both of Tokyo, Japan

[21] Appl. No.: 930,151

[22] Filed: Nov. 12, 1986

[30] Foreign Application Priority Data

Nov. 15, 1985 [JP] Japan ..... 60-257360

[51] Int. Cl.[4] ..... B24B 31/03

[52] U.S. Cl. ..... 51/7; 51/17

[58] Field of Search ..... 51/6, 7, 16, 17, 317–318

[56] References Cited

U.S. PATENT DOCUMENTS 2,899,777 8/1959 Davidson ..... 51/7
4,173,851 11/1979 Higashi ..... 51/317
4,175,930 11/1979 Sakulevich et al. ..... 51/317

FOREIGN PATENT DOCUMENTS 58-132455 8/1983 Japan .
60-34264 2/1985 Japan .
0480535 12/1975 U.S.S.R. ..... 51/317

*Primary Examiner*—Frederick R. Schmidt
*Assistant Examiner*—Robert A. Rose
*Attorney, Agent, or Firm*—Koda and Androlia

[57] ABSTRACT

An abrasing apparatus including an annular barrel having an upper opening. The barrel is rotated around an exciting coil and is filled with magnetic abrasive powder which is arranged by magnetic flux generated by the exciting coil to form magnetic brush. A work is embedded into the magnetic brush. The work is rotated together with a spindle and the barrel is rotated so that the surface of the work is abrased by the magnetic brush. A bottom magnetic pole, a lateral magnetic pole and an upper magnetic pole are disposed in an inner periphery in the barrel in the proximity to the exciting coil and the strong magnetic brush is locally formed therein. The side portion of the work is located in the local magnetic brush, and the bottom, side and upper surfaces of the work are abrased like a mirror surface.

5 Claims, 9 Drawing Figures

ABRASING APPARATUS USING MAGNETIC ABRASIVE POWDER

BACKGROUND OF THE INVENTION

1. Field of the Invention

The present invention relates to an abrasing apparatus using magnetic abrasive powder, and more particularly to an abrasing apparatus in which the magnetic abrasive powder filled in a barrel is arranged to be formed in chain-like bridge by a magnetic field generated in the barrel so that the surface of a work is abrased by a magnetic brush formed by the arrangement of the magnetic abrasive powder. Specifically, the present invention relates to the abrasing apparatus capable of directing the arrangement of the magnetic abrasive powder to an optimum direction for the abrasion.

2. Prior Art

An abrasing apparatus using magnetic abrasive powder is employed to abrase the surface of a metal work such as a bobbin case equipped in a sewing machine to a mirror-like surface.

FIG. 8 illustrates a structure of the abrasing apparatus using magnetic abrasive powder which has been proposed heretofore. The abrasing apparatus of FIG. 8 is disclosed in Japanese Patent Application No. 219,378/82 filed Dec. 16, 1982 in the Japanese Patent Office with the claim of convention priority based on Bulgarian Patent Application No. 55,025 filed Jan. 18, 1982. The application was laid open to public inspection on Aug. 6, 1983 under Provisional Publication No. 132,455/83. The abrasing apparatus is now described with reference to the figure.

The abrasing apparatus comprises a rotary barrel 1. The barrel 1 is rotatably supported on a stand 3 through a bearing 2. A follower pulley 4 is integrally mounted to a lower portion of the barrel 1 and rotary motion or power of a drive pulley 5 mounted to a shaft of a motor 7 is transmitted to the follower pulley 4 through a belt 6 so that the barrel 1 is rotated. Magnetic abrasive powder 9 is filled in a bottom portion of the barrel 1. The magnetic flux generated from an exciting coil 8 passes between an upper ring 10*a* and a lower ring 10*b* of the barrel 1 so that the magnetic abrasive powder 9 is arranged by the magnetic flux to form the magnetic brush. A disk 11 is provided with a spindle 13 which is rotated by a motor 14. A work 15 is attached to a lower end of the spindle 13. The work 15 is inserted within the magnetic brush formed in the barrel 1 and the surface of the work 15 is abrased by the magnetic brush through rotation of the barrel 1 and the spindle 13.

In the abrasing apparatus using the magnetic abrasive powder, the abrasion condition of the surface of the work is controlled by the strength of the arrangement of the magnetic abrasive powder in the barrel. The strength of the arrangement of the magnetic abrasive powder is largely affected depending on the magnetic density in the barrel and the direction of the magnetic flux. Since the magnetic flux in the prior art abrasing apparatus of FIG. 8 is merely formed in the barrel vertically, the arrangement force of the magnetic abrasive powder is weak as a whole and the magnetic brush is formed fragilely and weakly. Accordingly, the prior art abrasing apparatus can not abrase the surface of the work such as the bobbin case of the sewing machine like the surface of the mirror.

FIG. 9 shows partially another abrasing apparatus using magnetic abrasive powder which has been proposed heretofore. The abrasing apparatus of FIG. 9 is disclosed in Japanese Patent Application No. 143,120/83 filed Aug. 6, 1983 in the Japanese Patent Office. The application was laid open to public inspection on Feb. 21, 1985 under Provisional Publication No. 34,264/85. The prior art abrasing apparatus includes a magnetic abrasive powder 9 filled in the rotary barrel 21 in the same manner as the apparatus of FIG. 8. A plurality of segment magnetic poles 28 are disposed on an inner plate in the barrel 21 in spaced relationship with each other. A plurality of segment magnetic poles 29 spaced from each other are also disposed on the outside of the outer plate 20 and a plurality of segment magnetic poles 26 are further disposed to a bottom in spaced relationship with each other. A spindle 24 holding a work 25 is inserted into the barrel 21 from the upside thereof and the work 25 is embedded in the magnetic abrasive powder 9. The magnetic flux generated from an exciting coil 23 penetrates within the barrel 21 through a yoke 22 while the magnetic flux within the barrel 21 concentrates in the segment magnetic poles 26, 28 and 29. Accordingly, the magnetic abrasive powder concentrates locally and the magnetic brush is also locally formed depending on the arrangement of the segment magnetic poles 26, 28 and 29. The surface of the work 25 is abrased by rotation of the barrel 21 and the spindle 24. At this time, the surface of the work 25 is abrased by the magnetic brush formed locally.

In the abrasing apparatus of FIG. 9, however, the magnetic flux extending in the barrel 21 from the segment magnetic poles 28 is bent downward. Accordingly, the directivity of the magnetic flux is weakened and the magnetic flux tends to be scattered. Hence, it is insufficient to concentrate the magnetic abrasive powder and it is impossible to form strong magnetic brush by concentrating the magnetic abrasive powder enough to achieve an object of the present invention. Specifically, the force of the magnetic abrasive powder concentrating on the upper surface of the work can not be strong and the upper surface of the work can not be abrased like the surface of a mirror. A part of the magnetic flux is directed to the segment magnetic poles 29 provided outside. The magnetic flux directed to the outside magnetic poles 29 penetrates the poles 29 and is returned to the exciting coil 23 through the lower side of the barrel 21. Accordingly, since the magnetic circuit is long and the magnetic flux is scattered to be directed to the bottom and the outside of the barrel 21, the magnetic flux can not be utilized effectively. The arrangement force of the magnetic abrasive powder is reduced throughout the barrel.

SUMMARY OF THE INVENTION

It is an object of the present invention to concentrate magnetic abrasive powder in a barrel to an upper surface, a lateral surface and a lower surface strongly so that strong magnetic brush is formed to surround a work.

It is another object of the present invention to concentrate the magnetic flux to necessary part of a work to be abrased effectively, thereby eliminating the power consumption and preventing adhesion and generation of heat of the magnetic abrasive powder.

It is still another object of the present invention to establish a magnetic circuit formed by an exciting coil near the rotational center of the barrel to make the magnetic circuit short so that the scattering of the magnetic flux is prevented.

Further, the magnetic flux is concentrated at the rotational center of the bottom within the barrel so that it is prevented to scatter the magnetic abrasive powder by the centrifugal force of rotation of the barrel.

DETAILED DESCRIPTION OF THE INVENTION

Figure 1:
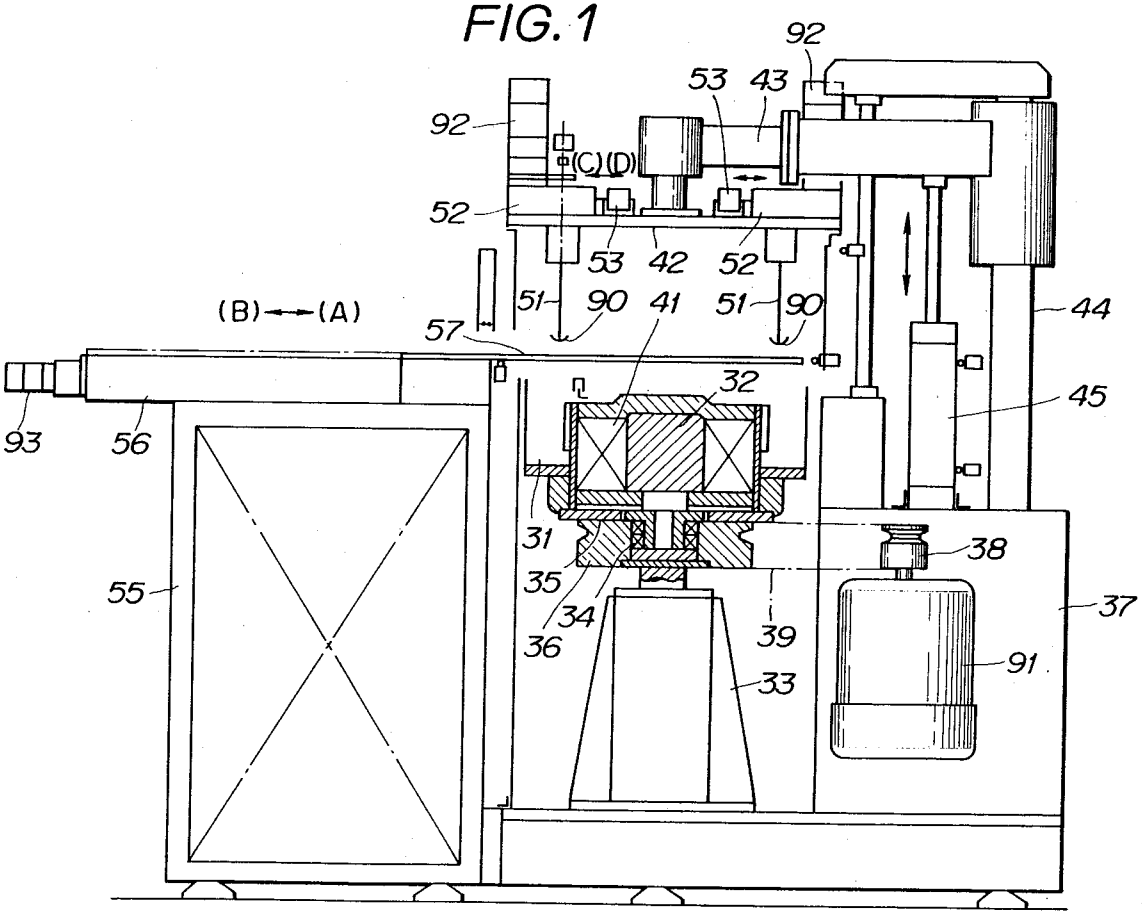
FIG. 1 is a front view showing an abrasive apparatus according to the present invention.
Figure 2:
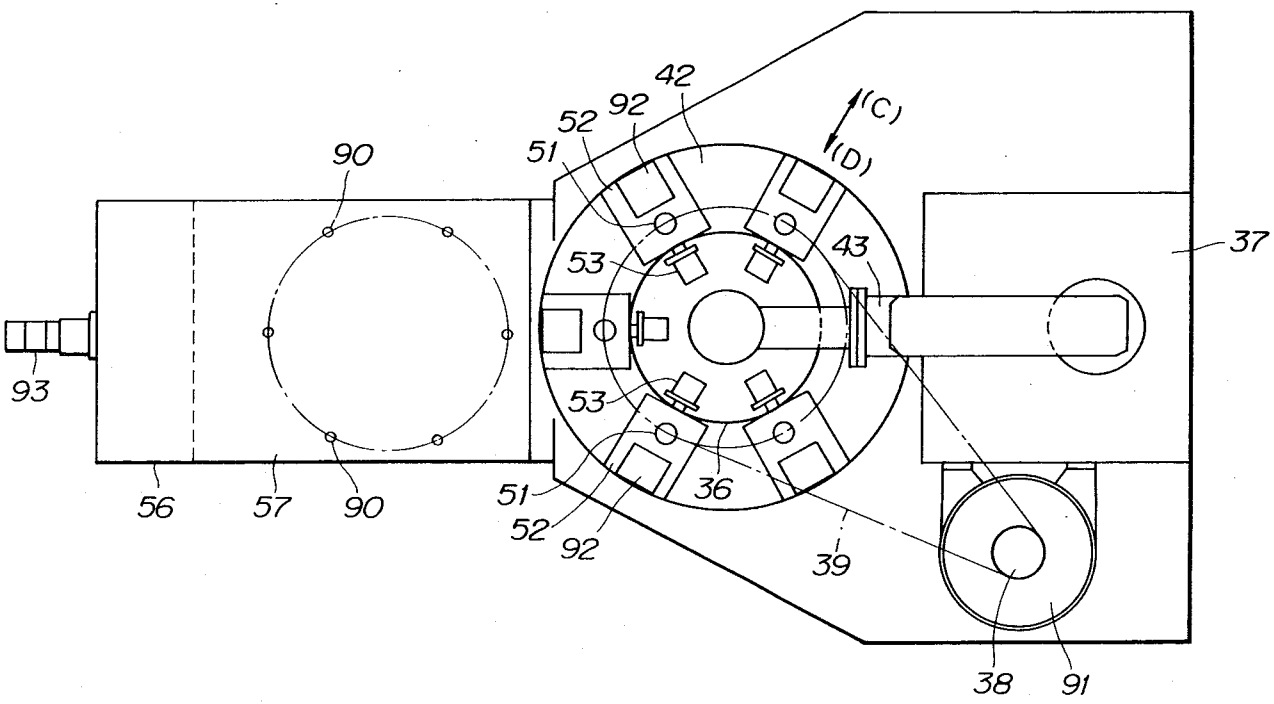
FIG. 2 is a plan view showing the abrasing apparatus according to the present invention.

Referring to FIGS. 1 and 2, there is shown a whole structure of an abrasing apparatus, which includes a rotary barrel 31. A stationary portion 32 is mounted on a base 33. A bearing 34 is provided under the stationary portion 32. A rotating member 35 and a follower pulley 36 which are integrally mounted to a lower end of the barrel 31 are rotatably supported to the stationary portion 32 through the bearing 34. Another base 37 is disposed at the side of the base 33 and a motor 91 is mounted on the base 37. A drive pulley 38 is fixedly attached to a rotary shaft of the motor 91 and a belt 39 is coupled between the drive pulley 38 and the follower pulley 36. The rotating member 35 and the barrel 31 are rotated together with the follower pulley 36 by the rotary motion of the motor 91. The stationary portion 32 is provided with an exciting coil 41. The exciting coil 41 is disposed in the proximity to the rotational center of the barrel 31. A magnetic circuit is formed within the space of the barrel 31 by the exciting coil 41.

A disk 42 is disposed above the barrel 31. The center of the disk 42 is fixedly mounted to an end of an up-and-down member 43. The up-and-down member 43 is supported to be able to be moved up and down through a guide shaft 44 by a vertically movable cylinder 45 which is provided on the base 37.

A plurality of spindles 51 are disposed on the disk 42 at regular intervals in the circumferential direction thereof. The spindles 51 are supported by a slide plate 52 provided on the upper surface of the disk 42. Motors 92 which rotate the spindles 51 are disposed on the slide plate 52. Air cylinders 53 are disposed on the disk 42 in spaced relationship with each other in the circumferential direction and are directed radially (refer to FIG. 2). The motors 92 and the spindles 51 can be moved together with the slide plate 52 in the radial direction (in the direction shown by (C)-(D)) of the disk 42 by the respective air cylinders 53.

Another base 55 is provided at the left side of the apparatus in the Figure. A rail 56 is mounted on the base 55 and a work feeding base 57 is provided on the rail 56. The work feeding base 57 can be guided by the rail 56 to move horizontally between the upside of the barrel 31 and the upside of the base 55 (in the direction shown by (B)-(A)). Further, a motor 93 for moving the work feeding base 57 forward and backward is provided on the base 55.

Figure 3:
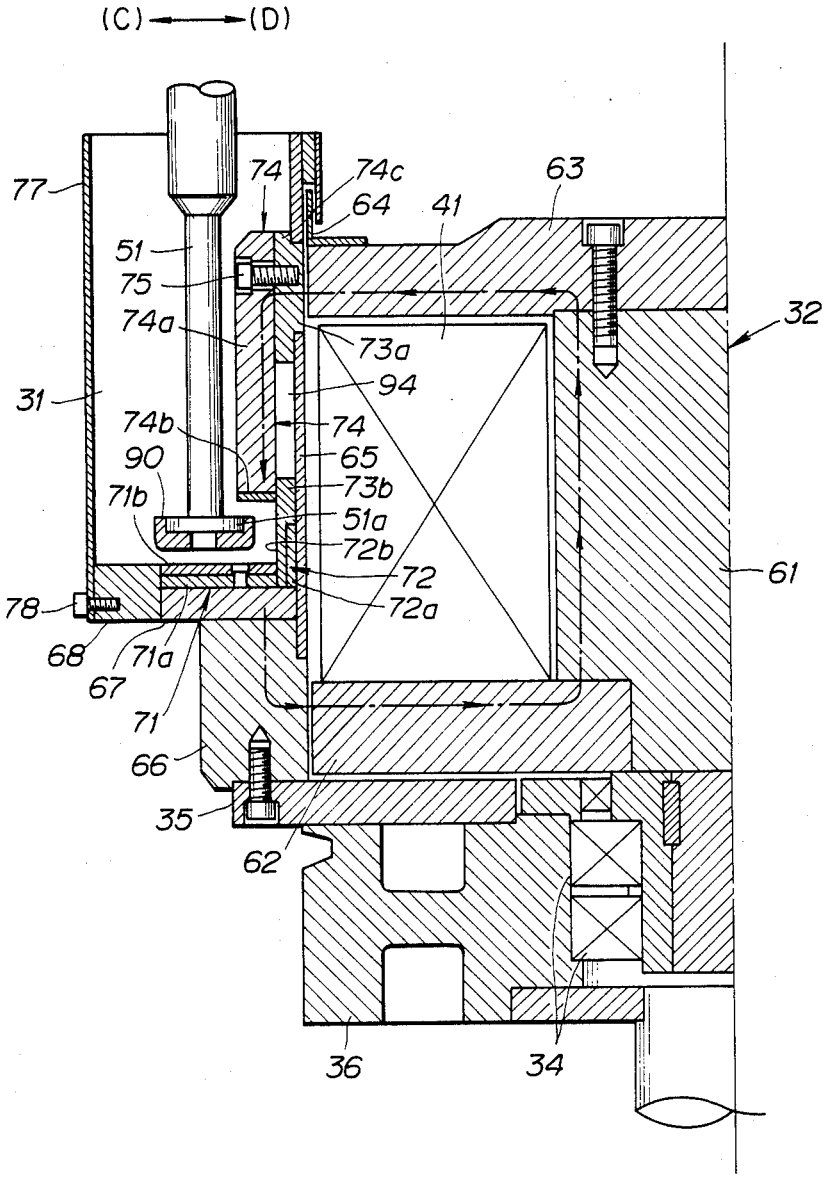
FIG. 3 is a partial sectional view showing a barrel of the abrasing apparatus according to the present invention.

Referring now to FIG. 3, the structure of the barrel 31 and its peripheral portion will now be described.

The stationary portion 32 includes a core 61 formed of magnetic material and the exciting coil 41 is wound on the outside of the core 61. A lower yoke 62 and an upper yoke 63 each formed of magnetic material are disposed under and above the exciting coil 41, respectively. A metal fitting 64 formed of non-magnetic material is fixedly mounted on the upper surface of the upper yoke 63 near the external edge thereof.

Figure 4:
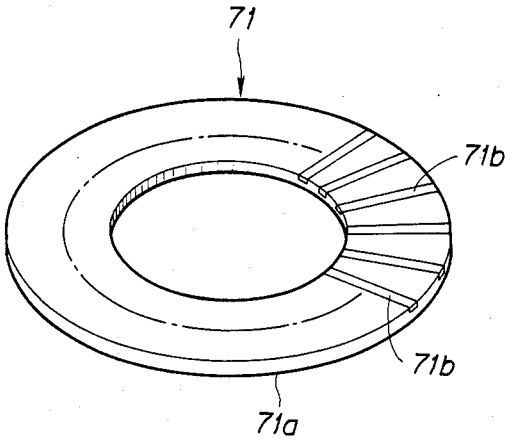
FIG. 4 is a perspective view showing a structure of a bottom magnetic pole in the barrel.

The barrel 31 is formed in a ring to surround the stationary portion 32 and the upper portion of the barrel 31 is opened. An inside plate 65 of the barrel 31 is formed of non-magnetic material and the inside plate 65 is closely opposed to the outside of the exciting coil 41 in spaced relationship with the coil 41. In the bottom of the barrel 31, a bottom plate 67 and an outer bottom plate 68 disposed adjacent to the outer periphery of the plate 67 are fixed mounted. The bottom plate 67 is fixed to the rotating member 35 and the follower pulley 36 through a coupling member 66. The member 66 and the bottom plate 67 are both formed of magnetic material. The outer bottom plate 68 is formed of non-magnetic material. A bottom magnetic pole 71 is disposed on the bottom plate 67. The bottom magnetic pole 71, as shown in FIG. 4, comprises a bottom ring **71*a* formed of magnetic material and segments 71*b* formed of non-magnetic material which are embedded in the upper surface of the bottom ring 71*a*. The bottom pole 71 is brought into contact with the inner periphery of the outer bottom plate 68 and the surfaces of the bottom pole 71 and the the outer bottom plate 68 are aligned with each other on the same plane. The plurality of segments 71*b* are embedded in the whole periphery of the bottom ring 71*a*** at regular intervals.

Figure 5:
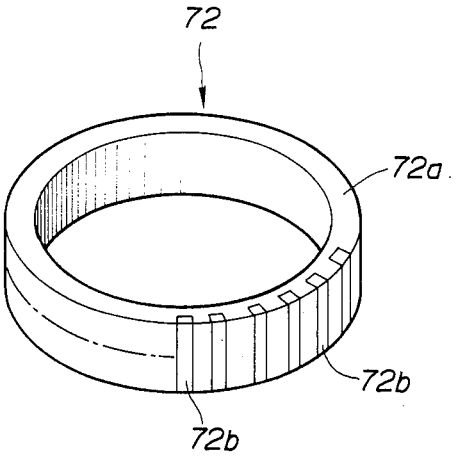
FIG. 5 is a perspective view showing a structure of a lateral magnetic pole in the barrel.

A lateral magnetic pole 72 is disposed inside the bottom of the barrel 31. The lateral magnetic pole 72 is disposed continuously to the inner end of the bottom magnetic pole 71 so that the pole 72 rises from the inner end of the pole 71. As shown in FIG. 5, the lateral magnetic pole 72 comprises a side ring **72*a* of magnetic material and segments 72*b* of non-magnetic material and embedded into the outer periphery of the ring 72*a*. The segments 72*b* are disposed in the whole outside periphery of the side ring 72*a*** at regular intervals.

Figure 6:
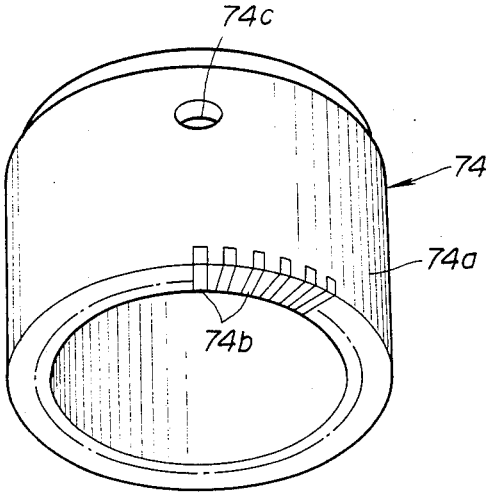
FIG. 6 is a perspective view showing a structure of an upper magnetic pole in the barrel.

A space 94 is provided adjacent to the outer periphery of the inside plate 65. A spacer **73*a* formed of magnetic material is disposed at the upper side of the space 94 and another spacer 73*b* formed of non-magnetic material is disposed at the lower side thereof. An upper magnetic pole 74 is disposed outside of both the spacers 73*a* and 73*b*. As shown in FIG. 6, the upper magnetic pole 74 comprises an upper ring 74*a* of magnetic material and segments 74*b* of non-magnetic material which are embedded in the lower surface of the upper ring 74*a*. The segments 74*b* are disposed in the whole lower surface of the upper ring 74*a* at regular intervals. The respective segments 71*b*, 72*b* and 74*b* of the bottom magnetic pole 71, the lateral magnetic pole 72 and the upper magnetic pole 74 are disposed at the same intervals. The upper magnetic pole 74 is formed with a plurality of holes 74c through which screws 75 are inserted to mount the upper magnetic pole 74 to the upper spacer 73a. The upper magnetic pole 74 can be removed by removal of the screws 75. Further, when the holes 74c are in the form of vertically elongated holes, the mounting position of the upper magnetic pole 74** can be vertically.

The barrel 31 is provided with a cover 77 defining its outer periphery. Since the side and upper magnetic poles 72 and 74 as described above are disposed near the inside plate 65, the cover 77 can be constructed in a simple structure independent of the magnetic poles. The cover 77 can be further mounted to the outer bottom plate 68 by screws 78 and can be removed simply. When the cover 77 is formed of transparent acryl plate, the inside of the barrel 31 can be seen through the transparent cover 77.

Operation of abrasing a work 90 is now described.

The work 90 is fed by the work feeding base 57. More particularly, when the work feeding base 57 is moved leftward (in the direction of (B)) in FIGS. 1 and 2 by rotary motion of the motor 93, a plurality of works 90 are put on the work feeding base 57 in a circle. The work feeding base 57 is moved in the direction of (A) to be positioned above the barrel 31 in a condition where the disk 42 is lifted up by the cylinder 45. When the work feeding base 57 is stopped above the barrel 31, the disk 42 is lowered and the works 90 are held by chucks 51a provided in a lower end of the spindles 51. Then, after the work feeding base 71 is moved back in the direction of (B) from the barrel 31, the disk 42 is further lowered. At this time, the plurality of air cylinders 53 disposed on the disk 42 are extended to move the slide plate 52 on the disk 42 in the outside direction (in the direction of (C)). When the disk 42 is lowered to insert the works 90 held at the lower end of the spindles 51 into the space of the barrel 31 entirely, the air cylinders 53 on the disk 42 are shortened to move the slide plate 52 toward the center of the disk 42 (in the direction of (D)). Consequently, the works 90 move to a position where the sides of the works 90 is surrounded by the bottom magnetic pole 71, the lateral magnetic pole 72 and the upper magnetic pole 74.

Figure 7:
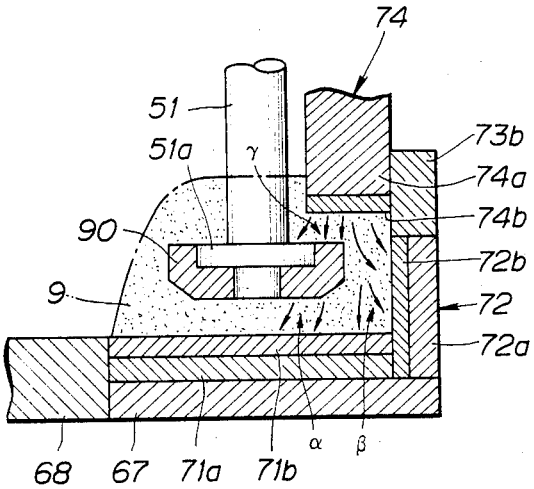
FIG. 7 is a partial sectional view showing the inside of the barrel and a work inserted in the barrel.
Figure 8:
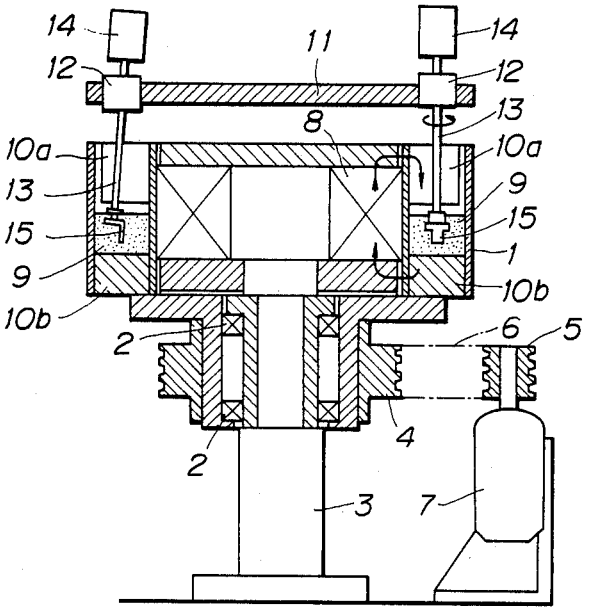
FIG. 8 (Prior Art)
FIG. 8 is a sectional view showing a prior art abrasing apparatus using magnetic abrasive powder.
Figure 9:
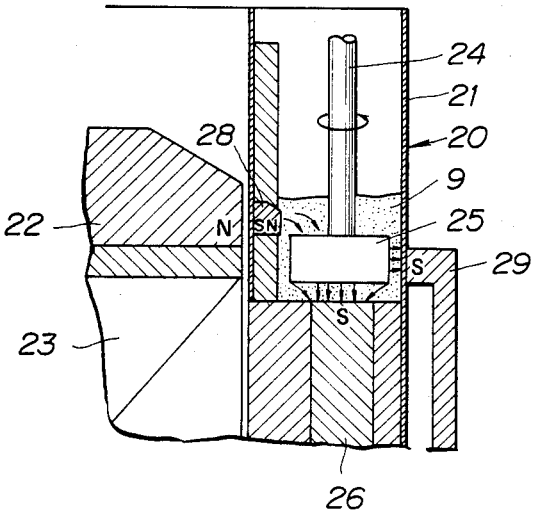
FIG. 9 (Prior Art)
FIG. 9 is a partial sectional view showing another prior art abrasing apparatus using magnetic abrasive powder.

As shown in FIG. 7, the inside bottom portion of the barrel 31 is filled with magnetic abrasive powder represented by numeral 9. That is, the work 90 inserted in the barrel as described above is embedded within the magnetic abrasive powder 9.

When the exciting coil 41 disposed at the stationary portion 32 is energized, a magnetic circuit is formed as shown by arrow in FIG. 3. That is, the magnetic flux penetrates the core 61, the upper yoke 63, the spacer 73a and the upper ring 74a forming the upper magnetic pole 74. FIG. 7 shows the work 90 formed of magnetic material. The magnetic flux passes from the lower end of the upper magnetic pole 74 to the upper side end of the work 90 and further passes through the inside of the work 90 to the bottom magnetic pole 71 and the lateral magnetic pole 72. Further, the magnetic flux passes from the bottom magnetic pole 71 and the lateral magnetic pole 72 through the bottom plate 67, the coupling member 66 and the lower yoke 62 to the core 61. Since the lateral magnetic pole 72 and the upper magnetic pole 74 are disposed in the position near the inside plate 65 of the barrel 31, that is, in the position adjacent to the exciting coil 41, the magnetic flux passes through the minimum magnetic circuit around the periphery of the exciting coil 41. Accordingly, the magnetic circuit is formed effectively by the exciting coil 41 so that the magnetic flux from the upper magnetic pole 74 toward the bottom magnetic pole 71 and the lateral magnetic pole 72 can be prevented from being scattered toward other directions.

As described above, the bottom ring 71a of the bottom magnetic pole 71 is formed of magnetic material and the segments 71b of non-magnetic material are embedded in the surface of the ring 71a at regular intervals. Further, the segments 72b of non-magnetic material are also embedded in the side ring 72a of magnetic material forming the lateral magnetic pole 72 at regular intervals. The segments 74b of non-magnetic material are also embedded in the upper ring 74a of magnetic material forming the upper magnetic pole 74. The magnetic flux concentrates at the boundaries between the magnetic rings 71a, 72a and 74a and the corresponding non-magnetic segments 71b, 72b and 74b and the magnetic flux density is increased therein. Accordingly, the magnetic abrasive powder is concentrated therein locally and intensively and the strong magnetic brush is formed therein with high density. Further, for the side portion of the work 90 (the right side of FIG. 7), the lower surface of the work 90 is opposed to the bottom magnetic pole 71, the side of the work is opposed to the lateral magnetic pole 72 and the upper surface of the work is opposed to the upper magnetic pole 74. That is, the magnetic poles are opposed to the side portion of the work 90 in three directions. Accordingly, the strong magnetic brush of the magnetic abrasive powder 9 is formed in the lower side $\alpha$, the lateral side $\beta$ and the upper side $\gamma$. Further, as described above, since the magnetic circuit is formed through the shortest path around the exciting coil 41, even if the supply power to the exciting coil 41 is small, the strong magnetic brush can be formed so that the magnetic flux density in the portions $\alpha$, $\beta$ and $\gamma$ can be increased.

In the abrasing operation, the rotating member 35 and the barrel 31 are rotated about the stationary portion 32 by the motor 91 in the normal and reverse directions. At the same time, the spindles 51 are rotated by the respective motors 92 provided on the disk 42 and the works 90 are also rotated within the magnetic abrasive powder 9. There is a case where the works 90 are temporarily stopped from rotating during the abrasing operation, if necessary. As described above, since the magnetic flux density in the portions $\alpha$, $\beta$ and $\gamma$ is high and the strong magnetic brush is hence formed with high density therein, the rotation of the barrel 31 and the works 90 abrases the lower surface, the lateral surface and the upper surface of the works 90 uniformly like a mirror surface.

In this manner, since the magnetic flux is effectively concentrated to the portions $\alpha$, $\beta$ and $\gamma$ in the inner bottom portion of the barrel 31, the magnetic abrasive powder 9 brought into contact with the side of the work 90 is arranged with optimum density and in average and the magnetic abrasive powder 9 is not adhered and not heated during rotation of the work 90. Further, since the magnetic abrasive powder 9 concentrates near the rotational center in the barrel 31, the magnetic abrasive powder 9 is not scattered by the centrifugal force of the barrel.

After the abrasing operation has been finished, the air cylinders 53 on the disk 42 are extended to move the spindles 51 in the direction of (C) together with the respective slide plates 52, so that the side portion of the work 90 is extracted from below the upper magnetic pole 74. At this condition, the cylinder 45 is extended to lift the disk 42 so that the spindle 51 is extracted from the barrel 31.

Then, the work feeding base 57 is extended by the motor 93 in the direction of (A) and the work feeding base 57 is stopped when it moves above the barrel 31. The chucks 51 mounted to the lower end of the spindles 51 are released and the works 90 are returned on the work feeding base 57. The work feeding base 57 is moved in the direction of (B) so that the works 90 can be removed.

The shorter the spaces in the portions $\alpha$, $\beta$ and $\gamma$ shown in FIG. 7, that is, the corresponding spaces between the bottom, the side and the upper surface of the work 90 and the bottom magnetic poles 71, the lateral magnetic pole 72 and the upper magnetic pole 74 are, the higher the density of arrangement of the magnetic brush is. While the ideal spaces in the portions are different depending on the strength of the magnetic field generated by the exciting coil 41 and materials forming the magnetic poles, it is desirable that the spaces are about 5 mm, for example.

Further, since the vertical mounting position of the upper magnetic pole 74 can be adjusted by loosening the screws 75, the spaces among the work 90, the bottom magnetic pole 71 and the upper magnetic pole 74 can be adjusted to meet the size and the shape of the work 90 if the upper magnetic pole 74 is moved to meet the size of the work 90 and the lower position of the spindle is established correspondingly.

It is ideal that the shape of the magnetic poles 71, 72 and 74 matches to the shape of the work 90. For example, when the peripheral shape of the work 90 is curved, it is desirable to make the surface shape of the bottom magnetic pole 71, the lateral magnetic pole 72 and the upper magnetic pole 74 curved. In this case, the screw 78 is loosened to remove the cover 77 of the barrel 31 and a tool is inserted into the barrel 31 so that the bottom magnetic pole 71 and the upper magnetic pole 74 can be easily replaced with magnetic poles corresponding to the shape of the works 90. Further, since the cover 77 can be easily removed, the inside of the barrel 31 can be easily cleaned.

Actual data in abrasing operation of the magnetic abrasing apparatus according to the above embodiments is now described.

The barrel 31 having an outer diameter of 630 mm and an inner diameter of 432 mm has been used. The segments **71*b* of the bottom magnetic pole 71, the segments 72*b* of the lateral magnetic pole 72 and the segments 74*b* of the upper magnetic pole 74 are about 10 mm in width, respectively. The exciting coil 41 which generates magnetic force of about 10,000 ampere-turns has been used and has been supplied with a power having DC 200 volts and 1 to 3 amperes so that the magnetic field of 2,000–8,000 gausses is generated at the magnetic poles 71, 72 and 74. A bobbin case of a sawing machine formed of alloyed steel has been used as the work 90. Further, a chemical reactive material of aluminum oxide and iron with mixture of iron particles and lubricating oil of 3–5% which gives viscosity and with a diameter of 80$\mu$ has been used as the magnetic abrasive powder 9**.

Under the above condition, the barrel 31 has been rotated at a speed of 125 rpm for four minutes in total including the normal rotation of two minutes and the reverse rotation of two minutes. The works 90 have been also rotated at a speed of 4.3 rpm continuously. Consequently, the lower surface, the side surface and the upper surface of the works 90 have been all abrased like a polished surface of a mirror. Further, the rotational power of the barrel 31 was as low as 1.5 KW. The temperature of the work surface and the magnetic abrasive powder 9 were not so high and almost all of the magnetic abrasive powder 9 was not scattered.

We claim:

1. An abrasing apparatus using magnetic abrasive powder comprising:

an exciting coil which is wound on an outer periphery of a core disposed between an upper yoke and a lower yoke and is fixedly mounted on a base;

a barrel including an inner plate disposed around an outer periphery of said exciting coil in spaced relationship with the outer periphery, a bottom plate, a cover defining an outer periphery of said barrel and an upper opening to form annular space in which magnetic abrasive powder is filled, said barrel being rotated about a rotational axis by a motor along an outside of said exciting coil on the base;

a bottom magnetic pole which is fixedly mounted to said bottom plate of said barrel and includes a surface in which magnetic members and non-magnetic members are alternately disposed along a rotational direction of the rotational axis of said barrel;

a lateral magnetic pole which is fixedly mounted to said inner plate and includes a surface in which magnetic members and non-magnetic members are alternately disposed along the rotational direction of the rotational axis of said barrel;

an upper magnetic pole which is fixedly mounted to said inner plate of said barrel so that said upper magnetic pole is disposed above said lateral magnetic pole and includes magnetic members and non-magnetic members which are alternately disposed along the rotational direction of the rotational axis of said barrel in a surface opposed to said surface of said bottom magnetic pole in spaced relationship with said surface of said bottom magnetic pole; and a spindle inserted into said barrel from upside thereof and including a lower end having a chuck for holding a work of which side portion is disposed within abrasion space surrounded by said bottom magnetic pole, said lateral magnetic pole and said upper magnetic pole, said spindle being rotated by a motor provided on said barrel.

2. An abrasing apparatus according to claim 1, comprising a disk disposed above said barrel and including motors thereon which drive a plurality of spindles, respectively, which hang down from said disk into said barrel, a first drive source for moving up and down said disk above said barrel so that said spindles are inserted in and removed from said barrel, and a second drive source which reciprocates said motors and one ends of said spindles in a radial direction of said disk so that a side portion of the work is inserted into and removed from abrasion space surrounded by said bottom magnetic pole, said lateral magnetic pole and said upper magnetic pole.

3. An abrasing apparatus according to claim 1, wherein said upper magnetic pole is mounted to said inner plate by a screw so that an opposite space between said upper magnetic pole and said bottom magnetic pole can be changed.

4. An abrasing apparatus according to claim 1, wherein said cover defining the outer periphery of said barrel is detachably mounted to an outer periphery of said bottom magnetic pole by a screw.

5. An abrasing apparatus according to claim 1, wherein said cover defining the outer periphery of said barrel is formed of transparent material.

* * * * *